US006108837A

United States Patent [19]

Knebel, III

[11] Patent Number: 6,108,837

[45] Date of Patent: Aug. 29, 2000

[54] SHEET RETAINING DEVICE

[76] Inventor: Andrew W. Knebel, III, 26831 NE. Bird St., Duvall, Wash. 98019

[21] Appl. No.: 09/083,360

[22] Filed: May 22, 1998

[51] Int. Cl.[7] ..... A47C 21/02

[52] U.S. Cl. ..... 5/504.1; 5/498; 24/72.5; 24/457

[58] Field of Search ..... 5/504.1, 503.1, 5/658, 659, 496, 497, 498; 24/72.5, 457

[56] References Cited

U.S. PATENT DOCUMENTS 1,049,942 1/1913 Syp ..... 5/498
2,611,165 9/1952 Straka ..... 24/72.5
4,702,443 10/1987 Callaway ..... 5/658 X
5,394,579 3/1995 Walters ..... 5/504.1

*Primary Examiner*—Terry Lee Melius
*Assistant Examiner*—James M Hewitt
*Attorney, Agent, or Firm*—Richard D. Multer

[57] ABSTRACT

Systems for securing bed clothes such as a flat or fitted sheet in place on a mattress and fasteners which can be used in those systems and for other purposes. In addition to fasteners, the bed clothes securing system includes a flexible lead displaceably affixed to the fasteners for drawing the corners of the bed sheet together.

9 Claims, 4 Drawing Sheets

SHEET RETAINING DEVICE

TECHNICAL FIELD OF THE INVENTION

In one aspect, the present invention relates to bed clothes and, more specifically, to novel, improved systems for holding such bed clothes in place.

In a second aspect, the present invention relates to novel, improved fasteners or retainers which can be employed in systems as characterized in the preceding paragraph and in a wide variety of other applications.

BACKGROUND OF THE INVENTION

Widely used are fitted or contoured bed sheets with side and end panels which conform to the edges of the mattress to which the bed sheet is fitted.

The commonly available bed sheets of this type rely on elastic straps to hold the bed sheet in place. This system is comparatively ineffective, and the bed sheet can be easily dislodged by the movements of one sleeping or lying on the mattress. The bed can then become uncomfortable, requiring that the bed sheet be put back in place. Particularly in the middle of the night, this can be a major inconvenience.

A number of systems for more securely holding a fitted bed sheet in place on a mattress have been proposed and disclosed in the following U.S. patents:

| Patent Number | Title | Issue Date |
|---|---|---|
| 2,727,253 | Contour sheets for mattresses | 12/20/55 |
| 2,857,643 | Contour sheets | 5/28/56 |
| 3,256,038 | Tensioning device for fabric covers | 9/15/64 |
| 3,858,256 | Fitted bedclothes | 1/7/75 |
| 4,495,233 | Removable cover adapted to cover three-dimensional articles | 1/22/85 |
| 4,660,240 | Device for attaching sheets to a waterbed | 4/28/87 |
| 4,727,608 | Fitted bed sheet and method of making same | 3/1/88 |
| 4,891,856 | Grasping system for use with a contoured sheet | 12/27/88 |
| 4,937,904 | Fitted sheet with sheet retainer | 7/3/90 |
| 5,046,207 | Adjustable bed sheet | 9/10/91 |

It is not believed that any of these patented bed sheet retainer systems have ever become commercially available. This is understandable as those systems seem to suffer such disadvantages as ineffectiveness, complexity, and the inability to be used with conventional fitted sheets.

Above-cited U.S. Pat. Nos. 2,857,643 and 4,660,240 disclose fitted bed sheet retainer systems with two-piece connectors or fasteners for securing tensioning straps to the corners of a fitted sheet. The fasteners disclosed in the '240 patent have a major drawback; they can be used only in applications in which there is a structural member to which the fastener can be attached by wood screws. Consequently, these fasteners are of limited application and certainly cannot be used to secure a fitted bed sheet to a conventional mattress.

Thus, there is a need for better ways of securing a fitted bed sheet in place on a mattress.

The '643 patent discloses a bed sheet retaining system which employs hose-type fasteners. These fasteners are difficult to use, or even impractical, if the fabric to which they are attached is thick, folded, or otherwise bulky. Furthermore, anchoring a pair of these fasteners in the requisite linear relationship needed to connect a retainer strap between the fasteners can prove awkward, at best.

Therefore, there is also a continuing need for fasteners which are versatile in that they can be secured to fabrics of widely varying thickness and in that they do not require wood screws or other devices to secure the fastener in place.

SUMMARY OF THE INVENTION

There have now been developed, and disclosed herein, certain new and novel bed sheet retainer systems which do not have the disadvantages of those previously proposed systems discussed above. These novel systems: are easy to use, can be employed to secure conventional fitted or flat sheets in place without modification of the sheet, simple and inexpensive to manufacture, versatile, especially in the sizes of sheets and thicknesses of fabric can be accommodated, and can be used without damage to the sheets they are employed to secure.

Broadly, the novel bed sheet retainer systems disclosed herein have fasteners which are secured to the corners of the fitted sheet and a lead which is trained seriatim through the four fasteners.

The lead is placed under tension with a ratchet-type or comparable device to draw the corners of the bed sheet together and securely hold that bed sheet in place on the mattress to which the bed sheet has been fitted.

Also disclosed herein are novel fasteners for use in the bed sheet retaining systems of the present invention and in a host of other applications. These novel fasteners have the advantages that they are easily applied to a bed sheet, do not damage the material to which they are secured, and have an adjustable latch which makes them capable of accommodating materials of different thicknesses. Because of this latter innovation, in particular, these novel fasteners can be used in an endless variety of applications to provide attachment points to artifacts fabricated from plastics, cloth, canvas, and other flexible, sheet type materials. Holes in the artifact are avoided, and a secure grip to the artifact is provided, even if the artifact is fabricated from a plastic or other slippery material.

The adjustable latch of the novel fasteners disclosed herein is incorporated in a frame which is one component of the fastener. A second, and the only other, component of the fastener is a spool with an external groove or recess in which the frame can fit. The material to which the fastener is to be attached is displaced over the pool sufficiently far to cover the groove in that component. The fastener frame is then placed over the material-spool assemblage in alignment with the spool's external groove. The latch is then engaged in the external spool groove to clamp the fabric between the spool and frame, the latch being tightened to the adjustable extent necessary to provide a secure connection.

The objects, features, and advantages of the invention will be apparent to the reader from the foregoing, the appended claims, and the ensuing detailed description and discussion of the invention, taken in conjunction with the accompanying drawings.

DETAILED DESCRIPTION OF THE INVENTION

Figure 1:
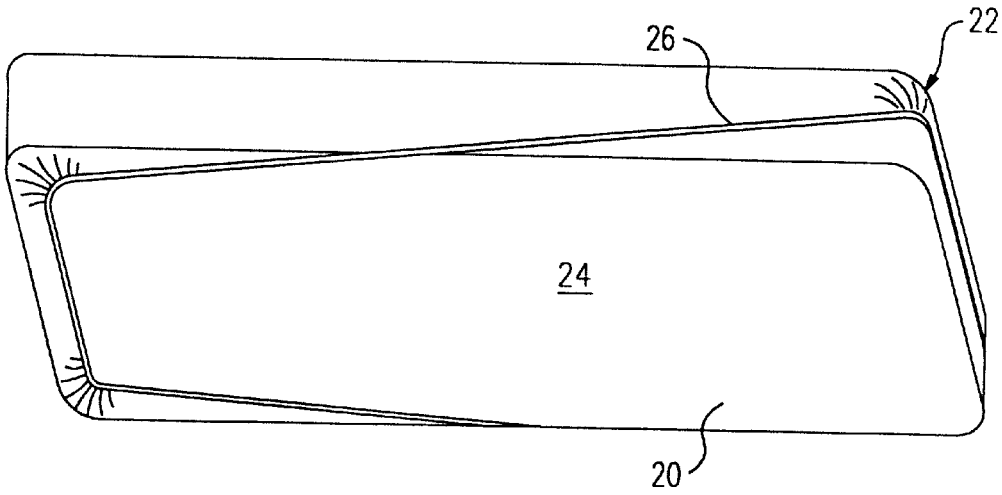
FIG. 1 PRIOR ART
FIG. 1 is a perspective view of a mattress and a fitted bottom sheet showing how a fitted sheet can become displaced by one sitting or lying on a bed made up with a sheet of that type.

Referring now to the drawings, FIG. 1 depicts a conventional mattress 20 made up with an equally conventional fitted or contoured sheet 22 which extends down over the mattress and onto the bottom 24 of that member. All that holds sheet 22 in place is an elastic band or strap 26. As suggested by FIG. 1 and as discussed above, this conventional bed sheet can be easily displaced by one sitting or lying on the mattress to which that sheet is assembled. This can lead to wrinkles and make lying on the mattress uncomfortable.

Figure 2:
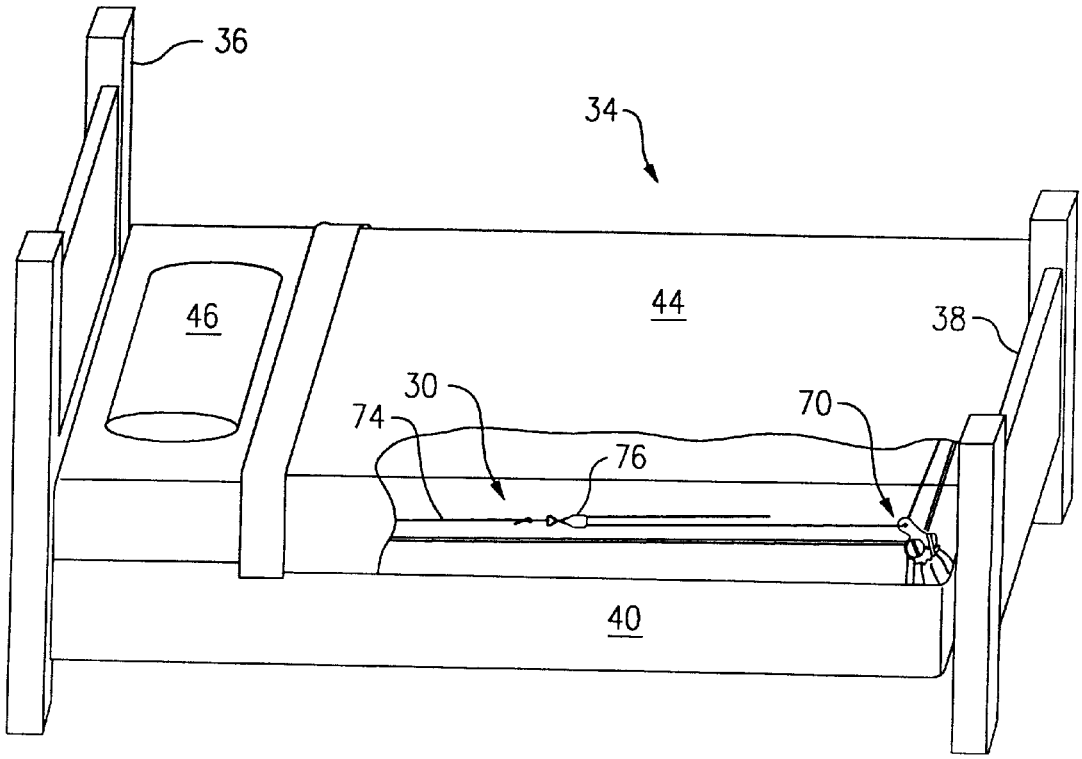
FIG. 2 is a perspective view of: (a) a bed made up with a fitted bottom sheet, and (b) a system embodying the principles of the present invention for retaining the fitted sheet in place on the mattress of the bed.
Figure 3:
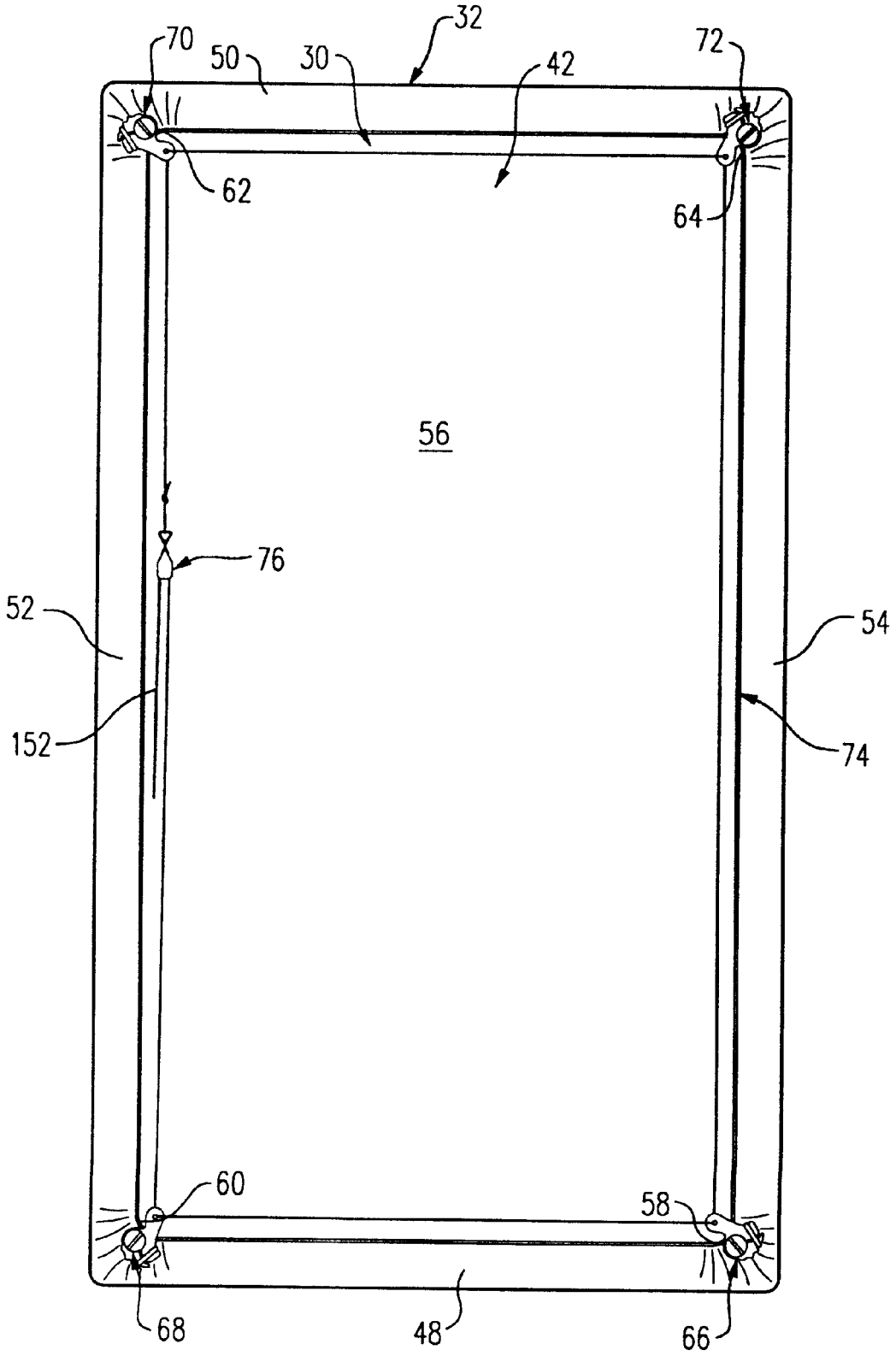
FIG. 3 is a bottom view of: (a) a mattress made up with a fitted sheet, with (b) the system embodying the principles of the present invention and illustrated in FIG. 1 securing the sheet in place on the mattress.

This problem is solved, in accord with the principles of the present invention, with a fitted sheet securing system as illustrated in FIGS. 2 and 3 and identified by reference character 30. This bed sheet retaining system is, in the illustrated exemplary application of the invention, employed to securely retain in place the contoured sheet 32 of a bed 34 which also includes a frame with a headboard 36 and a footboard 38, box springs 40, mattress 42, and a conventional top sheet 44 and pillow 46.

As in the conventional case illustrated in FIG. 1, fitted bottom sheet 32 has head, foot, and side panels 48, 50, 52, and 54 which cover the corresponding sides of mattress 42 and lap onto the bottom surface or side 56 of the mattress. These depending components 48 . . . 54 of fitted sheet 32 meet at four corners identified in FIG. 3 by reference characters 58, 60, 62, and 64.

The system 30 which holds bottom sheet 32 securely in place is shown in FIGS. 2 and 3 and includes four alike clamp-type fasteners 66, 68, 70, and 72; a line or cord 74 assembled to, and displaceable relative to, fasteners 66 . . . 72; and a conventional ratchet 76 which is utilized to adjust the tension on line 74 and draw the four elements 48 . . . 54 of fitted sheet 32 together to secure sheet 32 in place.

Figure 4:
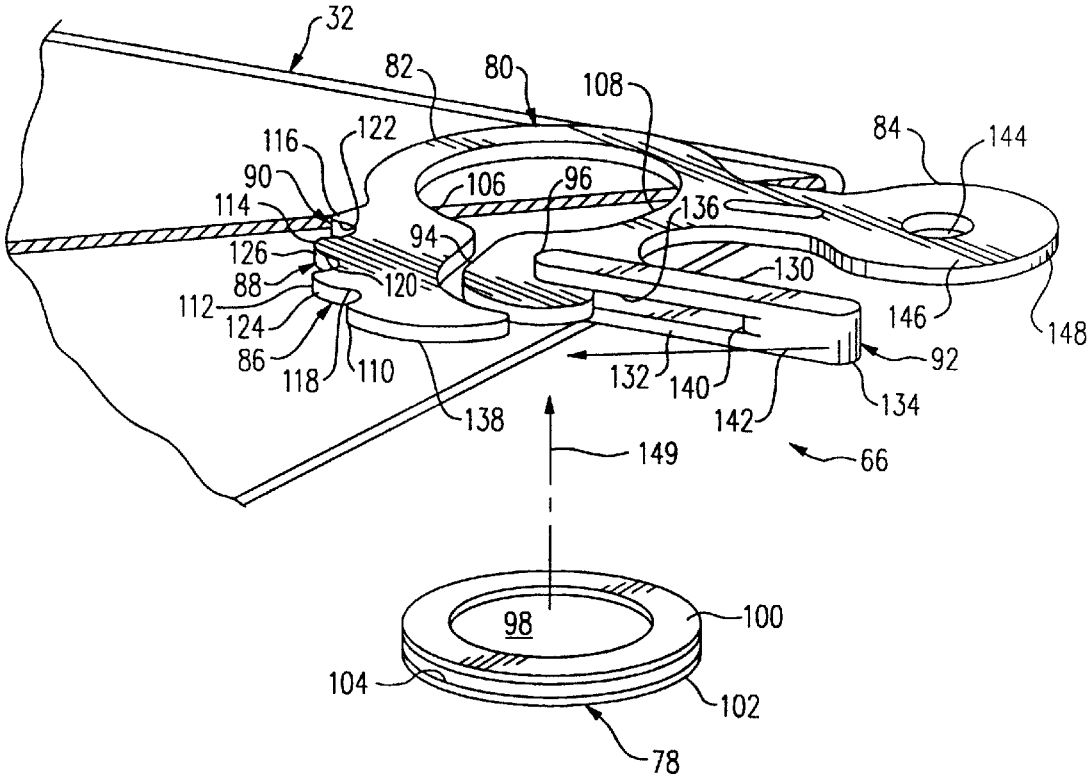
FIG. 4 is a fragmentary perspective and exploded view included to show the details of a novel latchable fastener which is a component of the bed sheet retaining system; this fastener embodies and is constructed in accord with the principles of the present invention.
Figure 5:
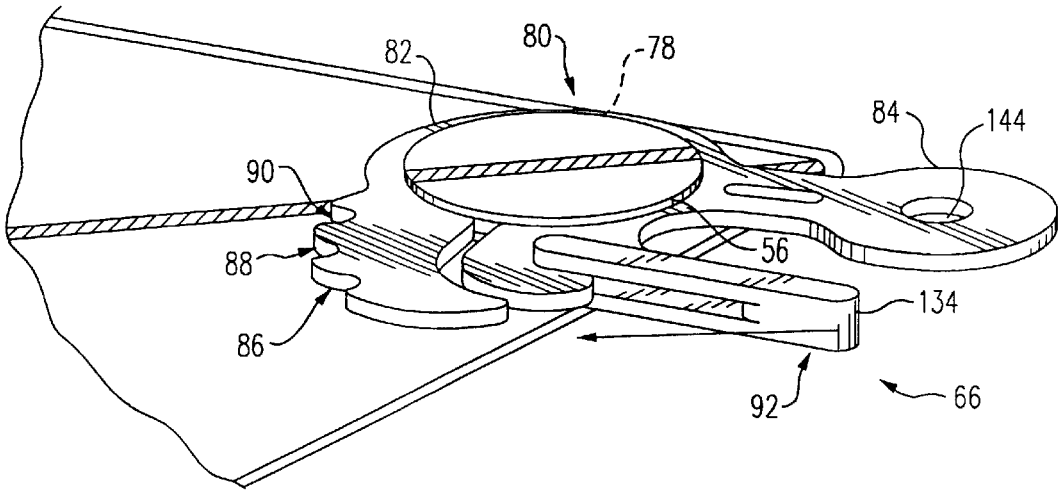
FIG. 5 is a perspective view of the fastener shown in FIG. with the fastener components engaged, the bed sheet trapped between those components, and the latch of the fastener open.
Figure 6:
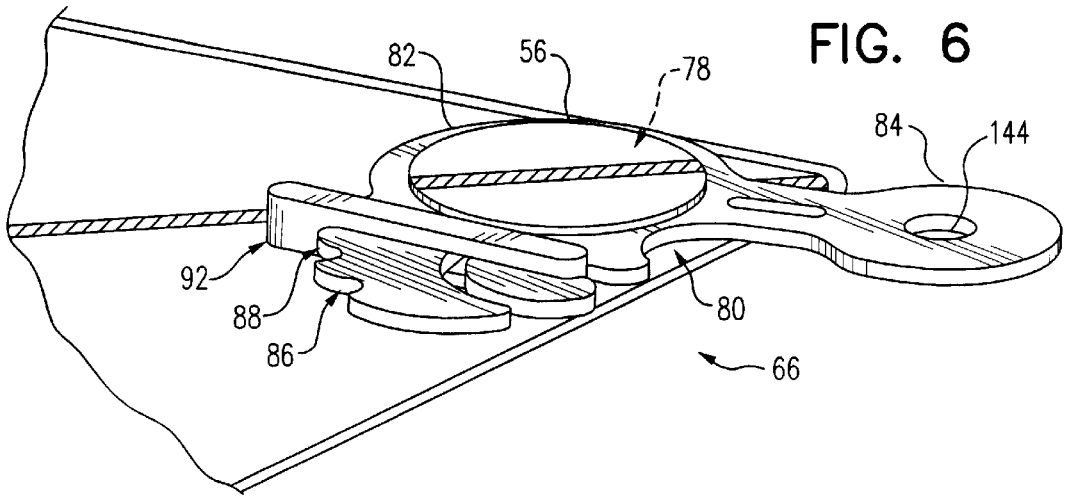
FIG. 6 is a view like FIG. 5 but with the latch of the fastener closed to secure it to the bed sheet.

With continued reference to FIGS. 2 and 3 and referring also to FIGS. 4–6, it was pointed out above that the four clamp-type fasteners 66 . . . 72 of bed sheet securing or retaining system 30 are alike. Consequently, only fastener 66, shown in FIGS. 4–6, will be described herein in detail.

Fastener 66 has three components: (a) spool 78; (b) a frame 80 which has a clamp 82 and an attachment fixture 84, and keepers 86, 88, and 90; and (c) a latch 92 pivotably fixed to an anvil segment 94 of fastener frame 80 at one end 96 of the latch.

With continued reference primarily to FIGS. 4–6, the spool 78 of fastener 66 has a circular hub 98 surrounded at the opposite sides thereof by spaced apart rims 100 and 102. Between and defined by rims 100 and 102 is an outwardly opening recess 104 which extends around the circumference of the spool 78.

Continuing with reference to FIGS. 4–6, the clamp 82 of fastener frame 80 is a resiliently displaceable, integral, arcuate segment of the frame. Complementary inwardly facing arcuately faced segments 106 and 108 of fastener frame 80 cooperate with clamp 82 to define an annulus into which spool 78 can be snapped with clamp 82 and the arcuately contoured segments 106 and 108 of the fastener frame trapped in the recess 104 of spool 78 between rims 100 and 102.

The keepers 86 . . . 90 of fastener 80 are defined by teeth 110, 112, 114, and 116 of fastener frame 80. Between adjacent pairs of these teeth and defined by those teeth are arcuate recesses 118, 120, and 122 in which latch 92 of fastener 66 can fit. Those edges 124 and 126 of teeth 112 and 114 facing latch 92 are preferably sloped as shown in FIGS. 4–6 so that the latch can be readily be displaced over the teeth.

Referring still to FIGS. 4–6, latch 92 of fastener 66 has a pair of parallel, spaced apart legs 130 and 132 and an integral handle 134 which cooperates with legs 130 and 132 to define a recess 136 with a transverse dimension somewhat greater than the thickness of fastener frame 80. This allows the latch to be displaced over the keeper-bearing segment 138 of fastener frame 80 until the curved surface 140 of the latch handle 134 is seated in one of the three keeper recesses 118 . . . 122. As latch 92 is successively displaced in the direction of arrow 142 into keeper recess 118 and then from that recess into recess 120 and thereafter into recess 122 of the illustrated keeper arrangement, clamp 82 of the fastener frame is drawn further toward anvil 94 to narrow the distance between clamp 82 and the installed spool 78.

The final major component of fastener frame 80 is attachment fixture 84. This is an integral, radially extending arm with an aperture 144 centrally located in a boss 146 at the outer end 148 of the arm.

Referring now to FIG. 2 as well as FIGS. 4–6, fastener 66 is affixed to fitted sheet 32 at corner 58 by positioning the sheet between spool 78 and fastener frame 80 (FIG. 4) then displacing the spool toward fastener frame 80 as indicated by arrow 149 in FIG. 4 until fastener frame 80 is seated in the groove 104 of spool 78 with sheet 32 trapped between the spool and the fastener frame (see FIG. 5). Latch 92 is then displaced in the direction indicated by arrow 142 until latch handle 134 is seated in one of the keeper grooves 118 . . . 122 (see FIG. 6). In the bed sheet securing application just described, the latch 92 of fastener 66 is typically seated in the last or innermost keeper groove 122 to draw keeper frame clamp 82 close to anvil 94 to make a secure connection between fastener 66 and the relatively thin, single ply material of sheet 32.

The alike fasteners 68, 70, and 72 are similarly clamped to the other three corners 60, 62, and 64 of sheet 32. Next, line 74 is threaded through the aperture 144 of fastener 66; then through the corresponding apertures of fasteners 60, 62, and 64; and, finally, through ratchet 76. The ratchet may be, as one example only, of the type supplied by Carolina North Manufacturing, Inc. of Kernersville, N.C. The free end 152 of line 74 is then pulled through ratchet 76 until line 74 is taut. That draws the sheet segments 48 . . . 54 together and securely retains the sheet in place on mattress 42.

As discussed above, the bed sheet securing application just described is only one of the many applications for which fasteners of the type disclosed herein and just described are suited. Indeed, the fasteners of the present invention may be employed in virtually any application in which a line, hook, etc. needs to be secured to sheet material, the only requirement being that that material have sufficient flexibility to be trained over the fastener spool and clamped between that component and the fastener frame.

Figure 7:
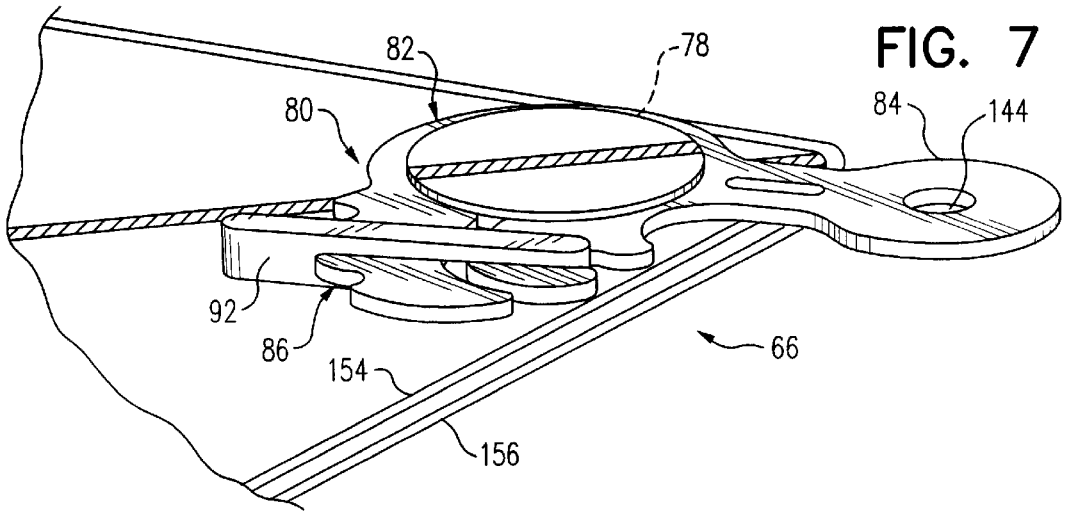
FIG. 7 is a view like FIG. 6 but with the latch engaged in an alternate keeper to accommodate a two-ply piece of material.
Figure 8:
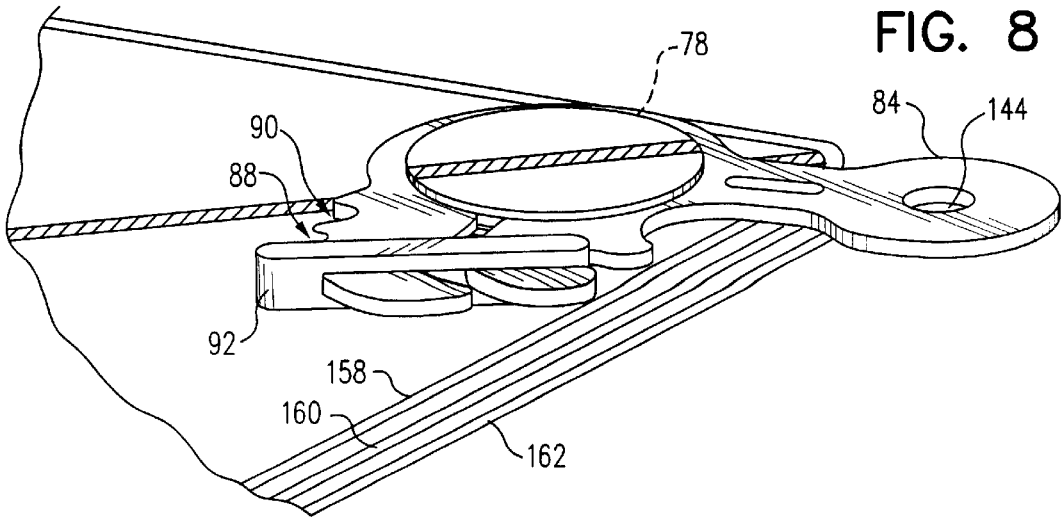
FIG. 8 is a view like FIGS. 6 and 7 but with the fastener latch engaged with yet another keeper to accommodate a still thicker piece of material.

If the material is of greater thickness, it may not be possible to displace keeper segment 138 of fastener frame 80 toward anvil 94 to the extent necessary to seat the fastener handle in keeper groove 122. In that instance, a secure connection can still be made between the material and fastener by seating the handle in keeper groove 120 (see FIG. 7 in which the material has two plies 154 and 156) or, if the material is even thicker, in keeper groove 118 (see FIG. 8). In the FIG. 8 example, the material has three plies 158, 160, and 162.

The present invention may embody many forms without departing from the spirit or essential characteristics of the invention. The present embodiment is therefore to be considered in all respects as illustrative and not restrictive. The scope of the invention is indicated by the appended claims rather than by the foregoing description, and all changes which come within the meaning and range of equivalency of the claims are therefore intended to be embraced therein.

What is claimed as the invention is:

1. The combination of a mattress, a bed sheet, and a fastener system for securing said bed sheet in place on said mattress;

said mattress having an upper surface and depending head, foot, and side edges;

said sheet having an element which covers the upper surface of the mattress and corners which extend down over the head, foot, and side edges of the mattress;

said fastener system comprising a set of fasteners and a flexible lead;

said fasteners being located at the comers of said sheet;

each of said fasteners comprising an externally grooved spool and a frame which comprises a clamp, a latch, and an attachment arm;

one corner of said sheet being trapped between the spool and the clamp of each said fastener; and said lead being displaceably fixed to said fastener frame attachment arms and being under tension to draw the corners of said sheet together and securely retain said sheet in position on the mattress.

2. A combination as defined in claim 1 in which said fastener system includes a ratchet fixed to said lead for adjusting the tension in the lead.

3. A combination as defined in claim 1 in which:

there are apertures in the attachment arms of said fasteners; and said lead is trained through said apertures.

4. A combination as defined in claim 1 in which the frame of each said fastener has multiple keepers alternatively engageable by said latch as to accommodate materials of different thicknesses between the spools and the frames of the fasteners.

5. A fastener which comprises a spool, a latch, and a frame:

said spool having a circular configuration and there being an external groove extending around a periphery of said spool;

said frame comprising: a flexible clamp and an attachment arm;

said clamp having a segment of arcuate configuration and being so cross-sectionally dimensioned as to fit into the external groove of said spool;

there being first and second frame segments at first and second ends of said arcuate clamp segment, said first and second frame segments being displacable toward each other to tighten said clamp against said spool;

said latch being pivotally fixed to the first frame segment; and the second frame segment having keepers alternatively engageable by said latch to vary spacing between said clamp and said spool to retain in place an article trapped between said clamp and said spool.

6. A fastener as defined in claim 5 in which said keepers are defined by margins of notches formed in said second frame segment.

7. A fastener as defined in claim 5 in which there is an attachment aperture in the attachment arm of said fastener frame.

8. A fastener as defined in claim 5 in which said clamp, said frame segments, and said attachment arm are integral components of said frame.

9. A fastener as defined in claim 5 in which said spool is so dimensioned relative to said frame that said frame can be snapped into the groove in said spool to secure said spool to said frame with said clamp trapped between marginal, groove-defining segments of said spool.

* * * * *